US007075444B2

(12) United States Patent
Tanguay

(10) Patent No.: US 7,075,444 B2
(45) Date of Patent: Jul. 11, 2006

(54) TEMPORARY ALARM LOCATE WITH INTERMITTENT WARNING

(75) Inventor: William P. Tanguay, Downers Grove, IL (US)

(73) Assignee: Maple Chase Company, Downers Grove, IL (US)

( * ) Notice: Subject to any disclaimer, the term of this patent is extended or adjusted under 35 U.S.C. 154(b) by 159 days.

(21) Appl. No.: 10/703,875

(22) Filed: Nov. 7, 2003

(65) Prior Publication Data

US 2004/0100375 A1 May 27, 2004

Related U.S. Application Data

(60) Provisional application No. 60/426,909, filed on Nov. 15, 2002.

(51) Int. Cl.
*G08B 17/10* (2006.01)

(52) U.S. Cl. ..... 340/628; 340/286.05; 340/514; 340/520

(58) Field of Classification Search ..... 340/520, 340/286.05, 628, 577, 332, 331, 326, 514, 340/523, 524
See application file for complete search history.

(56) References Cited

U.S. PATENT DOCUMENTS 4,019,139 A * 4/1977 Ortega ..... 340/297
4,060,803 A * 11/1977 Ashworth, Jr. ..... 340/506
4,535,321 A * 8/1985 Merz ..... 340/520
4,792,797 A 12/1988 Tanguay et al. ..... 340/628
RE33,920 E 5/1992 Tanguay et al. ..... 340/628
5,831,526 A 11/1998 Hansler et al. ..... 340/531
6,348,871 B1 2/2002 Tanguay et al. ..... 340/628
6,353,395 B1 3/2002 Duran ..... 340/691.1
6,426,703 B1 7/2002 Johnston et al. ..... 340/628

OTHER PUBLICATIONS

Combination Smoke and Carbon Monoxide Alarm, Kidde Fyrnetics, Model No. 900-0114E, admitted prior art.

(Continued)

*Primary Examiner*—Brent A. Swarthout
(74) *Attorney, Agent, or Firm*—Andrus, Sceales, Starke & Sawall, LLP

(57) ABSTRACT

A method of intermittently disabling the generation of an alarm signal by a plurality of interconnected adverse condition detectors during a temporary alarm locate period such that the adverse condition detector actually detecting the adverse condition can be identified. In an interconnected system of adverse condition detectors, all of the detectors generate an alarm signal when any of the detectors is sensing an adverse condition. When the test switch on any of the detectors not actually sensing the adverse condition is actuated, the alarm signal is inhibited on all of the detectors except the detector actually sensing the adverse condition. The alarm signal is inhibited for a majority of the alarm locate period and allowed to activate for only portions of the alarm locate period.

23 Claims, 5 Drawing Sheets

OTHER PUBLICATIONS

Single and Multiple Station Carbon Monoxide Alarms, UL Standard 2034, pp. 8A and 24, Nov. 14, 2001.
Single and Multiple Station Smoke Alarms, UL Standard 217, pp. 26, 33 and 34, Feb. 27, 1997, Aug. 10, 1998 and Jan. 4, 1999.
First Alert, Model SC01N—User's Manual, Oct. 1999.
Nighthawk, Kidde Safety Products, Model KN-COSM-1B, admitted prior art.
AC Powered Smoke and Carbon Monoxide Alarm With Battery Back-up and Silence Feature, BRK Electronics, Model SC61020B—User's Manual, ½.

* cited by examiner

TEMPORARY ALARM LOCATE WITH INTERMITTENT WARNING

CROSS REFERENCE TO RELATED APPLICATION

The present application is based on and claims priority to U.S. Provisional Patent Application Ser. No. 60/426,909 filed on Nov. 15, 2002.

BACKGROUND OF THE INVENTION

The present invention generally relates to an alarm system including multiple adverse condition detectors for detecting an adverse condition in a building. More specifically, the present invention is directed to a method and system for providing an improved method of determining which of the adverse condition detectors is sensing the adverse condition during the generation of an alarm signal by all of the adverse condition detectors.

Alarm systems which detect dangerous conditions in a home or business, such as the presence of smoke, carbon dioxide or other hazardous elements, are extensively used to prevent death or injury. In recent years, it has been the practice to interconnect different alarm units that are located in different rooms of a home. Specifically, smoke detecting systems for warning inhabitants of a fire include multiple detectors installed in the individual rooms of a home, and the detectors are interconnected so that the alarms of all the detectors will sound if only one detector senses any combustion products produced by a fire. In this way, individuals located away from the source of the combustion products are alerted as to the danger of fire, as well as those in closer proximity to the fire.

Although the generation of an audible alarm signal by each of the adverse condition detectors is an effective way to alert the building occupants that an adverse condition is occurring near one of the detectors, a desire exists to allow the occupants to rapidly determine which of the interconnected detectors is the detector actually sensing the adverse condition. This detector is often referenced to as the local detector.

One known method of indicating which of the adverse condition detectors is sensing the adverse condition is to activate a visual indicator on only the adverse condition detector that is sensing the adverse condition. Although this type of visual indication does allow the occupant to determine which of the detectors is generating the alarm condition, it requires the occupant to visually examine each of the alarms during the generation of the alarm signal. Thus, the occupant must allow the alarm signal to continue to operate while a visual inspection of each of the adverse condition detectors is undertaken.

Another system currently exists that disables the interconnect line extending between the multiple adverse condition detectors upon activation of a switch placed in the interconnected system. When the switch is activated, only the adverse condition detector sensing the adverse condition will continue to generate the alarm signal. The remaining remote alarm units are thus silenced for the entire duration of a predetermined silence period. In this manner, the occupants can simply depress a button or switch located somewhere within the building to disable the generation of the alarm signal by all of the adverse condition detectors except the adverse condition detector sensing the adverse condition and generating the local alarm signal. This system allows the occupant to more quickly determine which of the adverse condition detectors is sensing the adverse condition by listening for which of the detectors continues to generate the alarm signal after the switch has been activated.

In the prior art system identified above, the interconnect disabling circuit includes a timed feature such that the generation of the alarm signal by the remote interconnected adverse condition detectors is disabled for only a predetermined period of time, this period being preset at approximately ten minutes and subsequently enabled with each actuation of the appropriate button. However, during the entire duration of this disable period, the only alarm generating the alarm signal is the alarm sensing the adverse condition being sensed.

Although the alarm disable feature identified above is able to allow the occupant to more easily determine which of the adverse condition detectors is originating the alarm signal, disabling the generation of the alarm signal by the interconnected adverse condition detectors for an extended period of time may allow the occupants to fall into a momentary state of complacency. For instance, if the originating detector is in a distant corner or floor of a home, it may be either inaudible or diminished to a point that it does not call the occupant to immediate action. Since the point of having alarms sounding together is to provide the earliest warning of an adverse condition throughout the home, the disabling of the alarm signal by all of the interconnected adverse condition detectors for the entire disable period is not desirable.

SUMMARY OF THE INVENTION

The present invention provides a method of determining which adverse condition detector of a plurality of interconnected adverse condition detectors is sensing an adverse condition during the generation of an alarm signal by all of the adverse condition detectors. When one of the adverse condition detectors senses the presence of an adverse condition, the adverse condition detector generates a local alarm signal and an interconnect signal. Upon receiving the interconnect signal, the remaining interconnected remote adverse condition detectors simultaneously generate an alarm signal. Thus, when any one of the adverse condition detectors is sensing an adverse condition, all of the adverse condition detectors are sent into an alarm condition as is conventional.

The method of the present invention allows an occupant to actuate a test switch on any of the remote detectors to initiate an alarm locate period. During the alarm locate period, the local detector sensing the adverse condition continues to generate the alarm signal while the generation of the alarm signal by all of the remote detectors is intermittently disabled and enabled. Thus, during the alarm locate period, the only adverse condition detector continuously generating an alarm signal is the adverse condition detector actually sensing the adverse condition.

During the alarm locate period, which has a fixed duration, the interconnect signal alternates between a period of being enabled and disabled for a number of repeating alarm interrupt cycles. In a conventional smoke alarm system using a legacy DC level to indicate an interconnect status, this signal alternates between a high level and a low level for a number of repeating alarm interrupt cycles. During each alarm interrupt cycle, the interconnect signal has a high level for an enable period and a low level for a disable period. Each of the remote adverse condition detectors generates the alarm signal only during the enable period of each alarm interrupt cycle.

Preferably, the disable period of the alarm interrupt cycle is selected to be substantially longer than the enable period such that the remote detectors generate the alarm signal for only a small portion of the alarm interrupt cycle. The enable period allows the alarm signal to be generated by the remote adverse condition detectors such that an occupant is periodically reminded that an adverse condition has been detected by one of the adverse condition detectors of the alarm system. However, the enable period is selected to be significantly short in duration such that the occupant can audibly identify which of the adverse condition detectors is generating the local alarm signal.

In one embodiment of the invention, the alarm signal includes an alarm cycle having a series of spaced alarm pulses. The duration of the enable period is selected such that a multiple number of alarm cycles can occur during the enable period.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
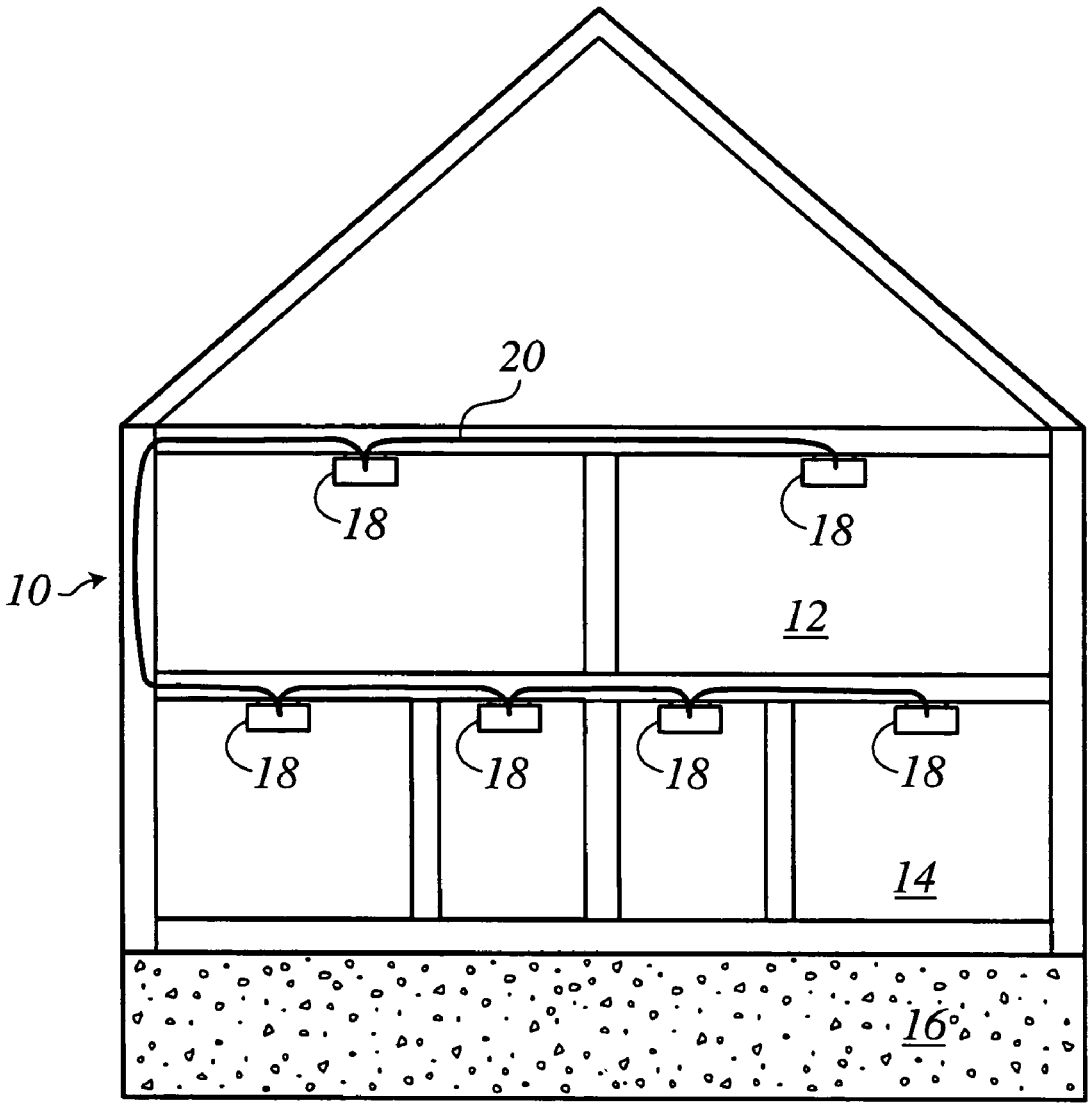
FIG. 1 is a general view of a plurality of remote adverse condition detectors that are interconnected with common conductors.

FIG. 1 illustrates a facility 10 having multiple levels 12, 14 and 16 with rooms on each level. As illustrated, an adverse condition detector 18 is located in each of the rooms of the facility 10 and the detectors 18 are interconnected by a pair of common conductors 20. The plurality of adverse condition detectors 18 can communicate with each other through the common conductors 20.

In FIG. 1, each of the adverse condition detectors 18 is configured to detect a dangerous condition that may exist in the room in which it is positioned. Generally speaking, the adverse condition detector 18 may include any type of device for detecting an adverse condition for the given environment. For example, the detector 18 could be a smoke detector (e.g., ionization, photo-electric) for detecting smoke indicating the presence of a fire. Other detectors could include but are not limited to carbon monoxide detectors, aerosol detectors, gas detectors including combustible, toxic and pollution gas detectors, heat detectors and the like.

In the embodiment of the invention to be described, the adverse condition detector 18 is a combination smoke and carbon monoxide detector, although the features of the present invention could be utilized in many of the other detectors currently available or yet to be developed that provide an indication to a user that an adverse condition exists.

Figure 2:
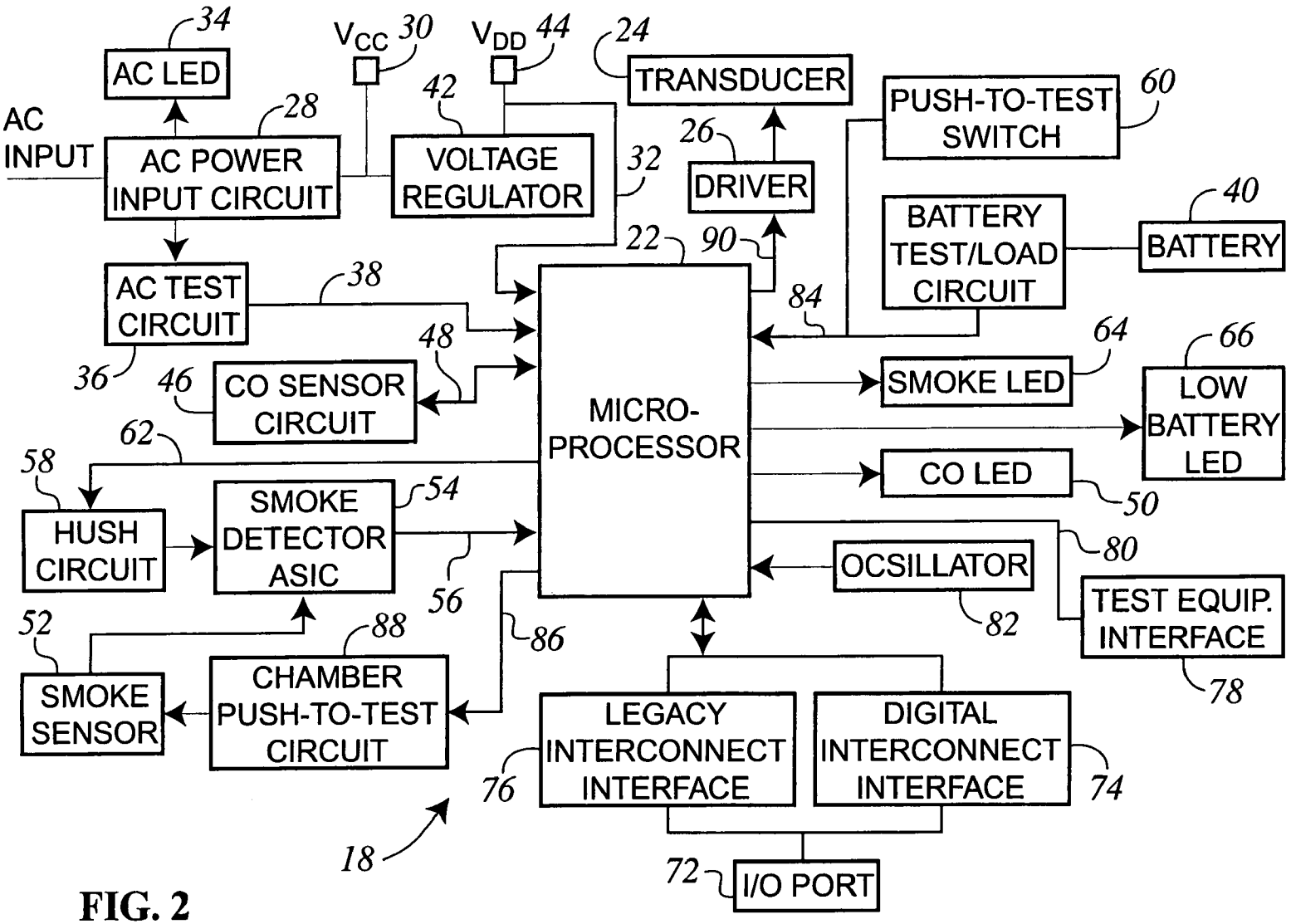
FIG. 2 is a block diagram of an adverse condition detector of the present invention.

Referring now to FIG. 2, thereshown is a block diagram of the adverse condition detector 18 of the present invention. As described, the adverse condition detector 18 of the present invention is a combination smoke and CO detector.

The adverse condition detector 18 includes a central microprocessor 22 that controls the operation of the adverse condition detector 18. In the preferred embodiment of the invention, the microprocessor 22 is available from Microchip as Model No. PIC16LF73, although other microprocessors could be utilized while operating within the scope of the present invention. The block diagram of FIG. 2 is shown on an overall schematic scale only, since the actual circuit components for the individual blocks of the diagram are well known to those skilled in the art and form no part of the present invention.

As illustrated in FIG. 2, the adverse condition detector 18 includes an alarm indicator or transducer 24 for alerting a user that an adverse condition has been detected. Such an alarm indicator or transducer 24 could include but is not limited to a horn, a buzzer, siren, flashing lights or any other type of audible, visual or other type of indicator that would alert a user of the presence of an adverse condition. In the embodiment of the invention illustrated in FIG. 2, the transducer 24 comprises a piezoelectric resonant horn, which is a highly efficient device capable of producing an extremely loud (85 dB) alarm when driven by a relatively small drive signal.

The microprocessor 22 is coupled to the transducer 24 through a driver 26. The driver 26 may be any suitable circuit or circuit combination that is capable of operably driving the transducer 24 to generate an alarm signal when the detector detects an adverse condition. The driver 26 is actuated by an output signal from the microprocessor 22.

As illustrated in FIG. 2, an AC power input circuit 28 is coupled to the line power within the facility. The AC power input circuit 28 converts the AC power to an approximately 9 volt DC power supply, as indicated by block 30 and referred to as $V_{CC}$. The adverse condition detector 18 includes a green AC LED 34 that is lit to allow the user to quickly determine that proper AC power is being supplied to the adverse condition detector 18.

The adverse condition detector 18 further includes an AC test circuit 36 that provides an input 38 to the microprocessor 22 such that the microprocessor 22 can monitor for the proper application of AC power to the AC power input circuit 28. If AC power is not available, as determined through the AC test circuit 36, the microprocessor 22 can switch to a low-power mode of operation to conserve energy and extend the life of the battery 40. The adverse condition detector 18 includes a voltage regulator 42 that is coupled to the 9 volt $V_{CC}$ 30 and generates a 3.3 volt supply $V_{DD}$ as available at block 44. The voltage supply $V_{DD}$ is applied to the microprocessor 22 through the input line 32, while the power supply $V_{CC}$ operates many of the detector-based components as is known.

In the embodiment of the invention illustrated in FIG. 2, the adverse condition detector 18 is a combination smoke and carbon monoxide detector. The detector 18 includes a carbon monoxide sensor circuit 46 coupled to the microprocessor 22 by input line 48. In the preferred embodiment of the invention, the CO sensor circuit 46 includes a carbon monoxide sensor that generates a carbon monoxide signal on input line 48. Upon receiving the carbon monoxide signal on line 48, the microprocessor 22 determines whether the sensed level of carbon monoxide has exceeded one of many different combinations of concentration and exposure time (time-weighted average) and activates the transducer 24 through the driver 26 as well as turning on the carbon monoxide LED 50. In the preferred embodiment of the invention, the carbon monoxide LED 50 is blue in color, although other variations for the carbon monoxide LED are contemplated as being within the scope of the present invention.

In the preferred embodiment of the invention, the microprocessor 22 generates a carbon monoxide alarm signal to the transducer 24 that is distinct from the alarm signal generated upon detection of smoke. The specific audible pattern of the carbon monoxide alarm signal is an industry standard and is thus well known to those skilled in the art.

In addition to the carbon monoxide sensor circuit 46, the adverse condition detector 18 includes a smoke sensor 52 coupled to the microprocessor through a smoke detector ASIC 54. The smoke sensor 52 can be either a photoelectric or ionization smoke sensor that detects the presence of smoke within the area in which the adverse condition detector 18 is located. In the embodiment of the invention illustrated, the smoke detector ASIC 54 is available from Allegro as Model No. A5368CA and has been used as a smoke detector ASIC for numerous years.

When the smoke sensor 52 senses a level of smoke that exceeds a selected value, the smoke detector ASIC 54 generates a local smoke alarm signal along line 56 that is received within the central microprocessor 22. Upon receiving the local signal, the microprocessor 22 generates an alarm signal to the transducer 24 through the driver 26. The alarm signal generated by the microprocessor 22 has a pattern of alarm pulses followed by quiet periods to create a pulsed alarm signal as is standard in the smoke alarm industry. The details of the generated alarm signal will be discussed in much greater detail below.

As illustrated in FIG. 2, the adverse condition detector 18 includes a hush circuit 58 that quiets the alarm being generated by modifying the operation of the smoke detector ASIC 54 upon activation of the test switch 60. If the test switch 60 is activated during the generation of the local alarm signal upon smoke detection by the smoke sensor 52, the microprocessor 22 will output a signal on line 62 to activate the hush circuit 58. The hush circuit 58 adjusts the smoke detection level within the smoke detector ASIC 54 for a selected period of time, referred to as the hush period, such that the smoke detector ASIC 54 will moderately change the sensitivity of the alarm-sensing threshold for the hush period. The use of the hush circuit 58 is well known and is described in U.S. Pat. No. 4,792,797 and RE33,920, incorporated herein by reference.

At the same time the microprocessor 22 generates the smoke alarm signal to the transducer 24, the microprocessor 22 activates LED 64 and provides a visual indication to a user that the microprocessor 22 is generating a smoke alarm signal. Thus, the smoke LED 64 and the carbon monoxide LED 50, in addition to the different audible alarm signal patterns, allow the user to determine which type of alarm is being generated by the microprocessor 22. The detector 18 further includes an optional low-battery LED 66.

When the microprocessor 22 receives the local smoke alarm signal on line 56, the microprocessor 22 generates an interconnect signal through the I/O port 72. In the preferred embodiment of the invention, the interconnect signal is delayed after the beginning of the alarm signal generated to activate the transducer 24. However, the interconnect signal could be simultaneously generated with the alarm signal while operating within the scope of the present invention.

The I/O port 72 is coupled to the common conduit 20 (FIG. 1) such that multiple adverse condition detectors 18 can receive the interconnect signal generated by the adverse condition detector that generates the local alarm signal upon actual detection of an adverse condition. Upon receiving the interconnect signal, each of the adverse condition detectors generates the alarm signal simultaneously. Thus, the multiple adverse condition detectors 18 can be joined to each other and sent into an alarm condition upon detection of an adverse condition by any of the adverse condition detectors 18.

Referring back to FIG. 2, the adverse condition detector 18 includes both a digital interconnect interface 74 and a legacy interconnect interface 76 such that the microprocessor 22 can both send and receive two different types of signals through the I/O port 72. The digital interconnect interface 74 is utilized with a microprocessor-based adverse condition detector 18 and allows the microprocessor 22 to communicate digital information to other adverse condition detectors through the digital interconnect interface 74 and the I/O port 72.

As an enhancement to the adverse condition detector 18 illustrated in FIG. 2, the legacy interconnect interface 76 allows the microprocessor 22 to communicate to so-called "legacy alarm" devices. The prior art legacy alarm devices are designed using an ASIC chip, such as Model No. A5368CA available from Allegro, and issue a continuous DC voltage along the interconnect common conductors 20 to any interconnected remote device during a local alarm condition. In the event that a microprocessor-based detector 18 is utilized in the same system with a prior art legacy device, the legacy interconnect interface 76 allows the two devices to communicate over the I/O port 72.

A test equipment interface 78 is shown connected to the microprocessor 22 through the input line 80. The test equipment interface 78 allows test equipment to be connected to the microprocessor 22 to test various operations of the microprocessor and to possibly modify the operating instructions contained within the microprocessor 22.

An oscillator 82 is connected to the microprocessor 22 to control the internal clock within the microprocessor 22, as is conventional.

During normal operating conditions, the adverse condition detector 18 includes a push-to-test switch 60 that allows the user to test the operation of the adverse condition detector 18. The push-to-test switch 60 is coupled to the microprocessor 22 through input line 84. When the push-to-test switch 60 is activated, the voltage $V_{DD}$ is applied to the microprocessor 22. Upon receiving the push-to-test switch signal, the microprocessor generates a test signal on line 86 to the smoke sensor via chamber push-to-test circuit 88. The push-to-test signal also generates appropriate signals along line 48 to test the CO sensor and circuit 46.

The chamber push-to-test circuit 88 modifies the output of the smoke sensor 52 such that the smoke detector ASIC 54 generates a smoke signal 56 if the smoke sensor 52 is operating correctly, as is conventional. If the smoke sensor 52 is operating correctly, the microprocessor 22 will receive the smoke signal on line 56 and generate a smoke alarm signal on line 90 to the transducer 24.

Figure 3A:
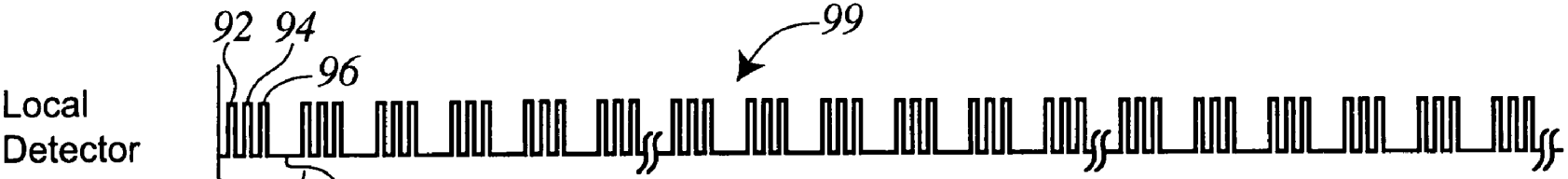
FIG. 3*a* is an illustration of the alarm signal produced by the local adverse condition detection apparatus of the present invention upon detection of an adverse condition.

Referring now to FIG. 3*a*, thereshown is the standard format for a local audible alarm signal 99 generated by the adverse condition detector upon generation of a level of smoke above a threshold value. Such a standard format is the ISO 8201:1987 audible emergency evacuation signal. As illustrated, the local alarm signal 99 has a repeating alarm cycle 90 that includes three alarm pulses 92, 94 and 96 each having a pulse duration of 0.5 seconds and separated from each other by an off time of 0.5 seconds. After the third alarm pulse 96, the temporal alarm signal has an off period 98 of approximately 1.5 seconds such that the alarm cycle 90 has a total alarm duration of approximately 4.0 seconds. After the completion of the first alarm cycle 90, the alarm cycle 90 repeats to define the temporal pattern of the local alarm signal 99. In FIG. 3*a*, the alarm signal 99 is shown being generated by the adverse condition detector that is actually sensing the adverse condition. This adverse condition detector will be referred to as the local detector for the remainder of the discussion to follow.

Figure 3B:
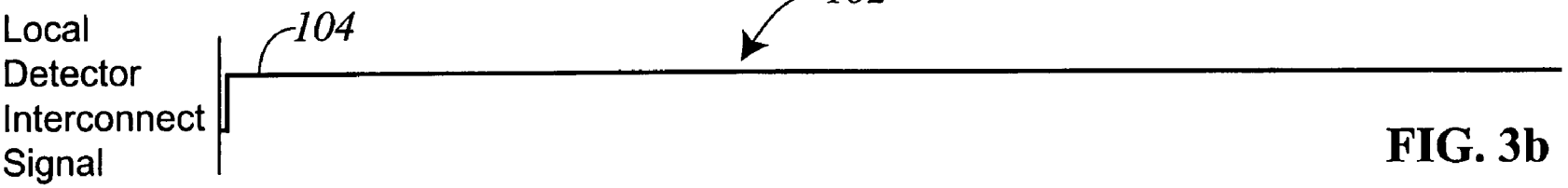
FIG. 3*b* is an illustration of the interconnect signal produced by the local adverse condition detection apparatus of the present invention.

Referring now to FIG. 3*b*, thereshown is the legacy interconnect signal 102 generated by the local detector at the same time that the local detector is generating the local alarm signal 99. The legacy interconnect signal 102 has a high level 104 sent to each of the interconnected adverse condition detectors along the common conductors 20. As illustrated in FIG. 2, when an adverse condition detector is a "remote" (non-sensing) unit, the remotely generated interconnect signal shown in FIG. 3*b* is received on the I/O port 72 and transmitted to the microprocessor 22 through the legacy interconnect interface 76. Alternatively, a digital interconnect signal may be transmitted along the common conductors 20 and be received via the digital interconnect interface 74, depending upon the type of adverse condition detector generating the interconnect signal 102.

When the interconnect signal 102 of FIG. 3*b* is at the high level 104, each of the remote interconnected adverse condition detectors that receives the interconnect signal begins to generate an audible alarm signal 103 (FIG. 3*c*) having generally the same alarm cycle 90 and series of alarm pulses 92–96 as the local alarm signal 99 shown in FIG. 3*a*. The interconnected adverse condition detectors that are not generating the local alarm signal will be referred to as remote detectors throughout the remainder of the present disclosure.

The interconnect signal 102 remains at the high level 104 for the entire duration that the local detector senses the adverse condition and is generating the local alarm signal. Once the local detector no longer senses the adverse condition, the local detector terminates generation of the local alarm signal and the interconnect signal 102 falls from the high level 104 to a grounded, low level. When the interconnect signal falls to the grounded low level, each of the remote detectors ceases to generate the audible alarm signal. This type of operation has been well known for many years and is a standard method of operating joined adverse condition detectors utilizing an interconnect signal, and thus has been referred to as a "legacy" interconnect signal.

During the period of time that all of the adverse condition detectors coupled to each other in the alarm system are simultaneously generating an alarm signal, the occupant is alerted to the presence of an adverse condition at one of the adverse condition detectors. As previously described, it is desirable to allow the occupant to more easily identify which of the actual adverse condition detectors is sensing the adverse condition during the generation of the alarm signal by all of the devices.

Figure 4:
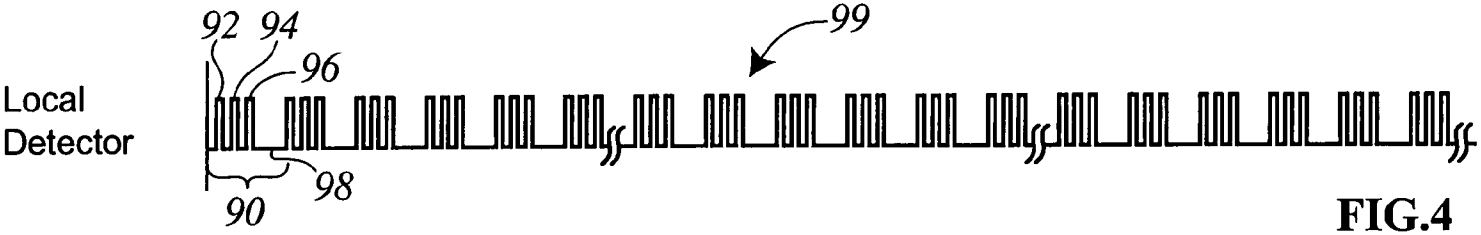
FIG. 4 is an illustration of the alarm signal produced by the local adverse condition detection apparatus of the present invention upon detection of an adverse condition.

FIG. 4 is an illustration of the alarm signal 99 generated by the local detector upon detection of an adverse condition. The alarm signal 99 shown in FIG. 4 is a duplicate of the alarm signal shown in FIG. 3*a* and is reproduced for the ease of illustration, as will be described in detail below.

Figure 5:
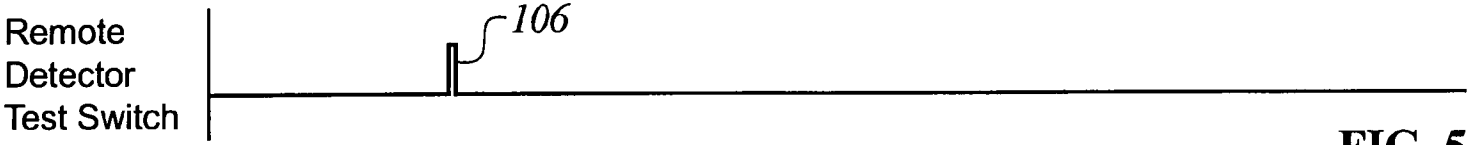
FIG. 5 is the signal generated by the test switch on one of the remote adverse condition detection apparatus that begins the Temporary Alarm Locate with Intermittent Warning period.

Referring now to FIG. 5, thereshown is a representation of the signal on line 84 of the adverse condition detector 18 of FIG. 2. Line 84 extends from the push-to-test switch 60 and is received at an input pin to the microprocessor 22. During normal operating conditions, line 84 is at ground level and no signal is being received at the microprocessor 22.

As illustrated in FIG. 5, if the user actuates the test switch 60 on any of the remote adverse condition detectors 18 during the generation of the alarm signal 99 by the local detector, as shown in FIG. 4, a test pulse 106 is generated. Upon generation of the test pulse 106, the alarm system of the present invention enters into a Temporary Alarm Locate with Intermittent Warning (TAL w/IW) condition that allows the user to audibly identify which of the adverse condition detectors is actually sensing the adverse condition while still periodically alerting the user to the presence of an adverse condition. In accordance with the present invention, the TAL w/IW period is controlled by controlling the level of the interconnect signal, thereby disabling the generation of the audible alarm signal from all of the remote detectors while allowing the local detector to continue to generate the alarm signal.

In accordance with the present invention, the exact electrical nature of the interconnect signal 102, as well as control over the interconnect signal 102 being sent from the local detector to the remote detectors, can be exerted in many different manners depending upon the physical configuration of the adverse condition detectors utilized in the alarm system. Regardless of how the control over the interconnect signal 102 is exerted, the overriding consideration of the present invention is the suspension of activation of the audible alarm signal by the remote detectors while enabling the local detector to continue to generate the alarm signal.

Figure 6:
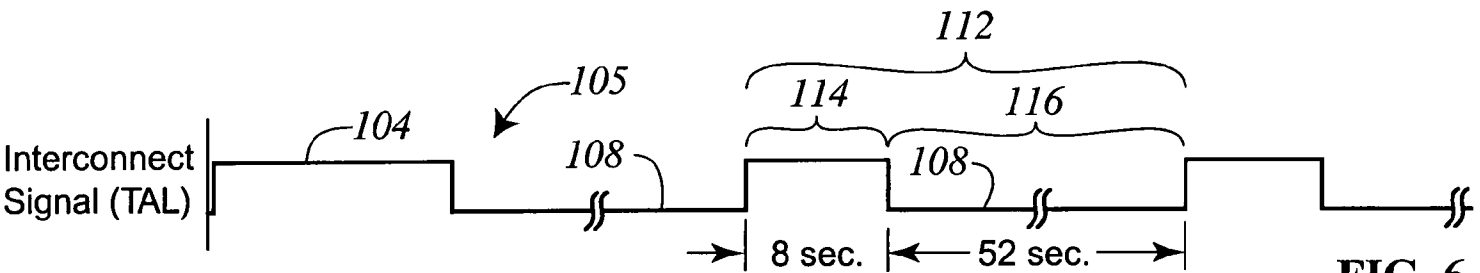
FIG. 6 is the effective interconnect signal that creates an enable period and a disable period to control the generation of the alarm signals by the remote adverse condition detectors.

Upon generation of the test pulse 106 as illustrated in FIG. 5, the TAL w/IW interconnect signal 105 being transmitted to the interconnected adverse condition detector falls to the low level 108, as illustrated in FIG. 6.

Figure 7:
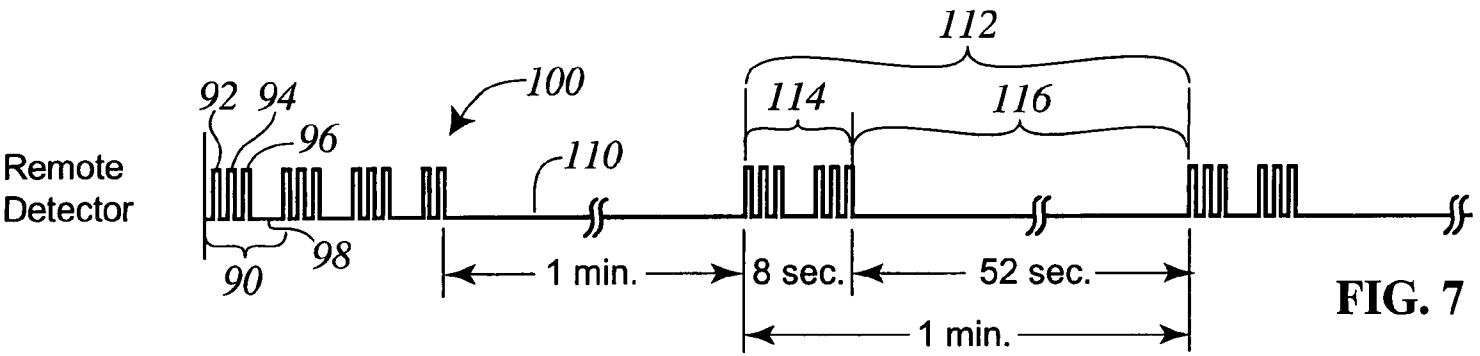
FIG. 7 is the audible alarm signal generated by the remote adverse condition detection apparatus both before and after the test switch has been actuated on one of the remote detectors.

When the TAL w/IW interconnect signal 105 falls to the low level 108, the alarm signal being generated by each of the remote detectors will be disabled, as indicated by the initial silence period 110 in FIG. 7. As illustrated in FIG. 5, the initial silence period 110 is for a period of approximately one minute, although the duration of the silence period is a matter of design choice. During this initial silence period 110, each of the remote detectors is inhibited from generating the alarm signal such that the only alarm signal being generated is by the local detector. Since the local detector is the detector sensing the adverse condition and is the only detector generating an alarm signal during this initial silence period 110, the user can easily identify which of the adverse condition detectors is sensing the adverse condition by listening for the single adverse condition detector generating the alarm signal.

Referring back to FIGS. 4 and 7, the test pulse warning 106 on a remote detector serves as the beginning of a Temporary Alarm Locate with Intermittent Warning (TAL w/IW) period in which the local detector generates the local alarm signal for the continuous duration of the TAL w/IW period while the remaining remote detectors are allowed to generate the alarm signal for only brief periods of time during the TAL w/IW period. In the embodiment of the invention being described, the Temporary Alarm Locate with Intermittent Warning (TAL w/IW) period has a duration of ten minutes, although other durations of time are contemplated as being within the scope of the present invention.

Referring back to FIG. 7, the alarm locate period includes multiple alarm interrupt cycles 112. In the embodiment of the invention illustrated, the alarm interrupt cycle 112 has a duration of approximately one minute, although other durations are contemplated by the inventor.

As shown in FIG. 6, during the alarm interrupt cycle 112, the TAL w/IW interconnect signal 105 is allowed to go to the high level 104 for an enable period 114 and is pulled to the low level 108 for a disable period 116. As illustrated in FIGS. 6 and 7, the disable period 116 has a duration of approximately 52 seconds compared to the enable period duration of approximately eight seconds.

Referring back to FIG. 7, during the enable period 114, the remote detectors are able to generate the series of pulses 92, 94 and 96 of the alarm signal, while the alarm signal is disabled during the disable period 116. In the preferred embodiment of the invention, the enable period 114 is selected to be a multiple of the alarm cycle 90 such that the alarm signal can be generated for at least two complete alarm cycles to maintain the integrity of the audible pattern of the alarm signal. For example, in the embodiment of the invention illustrated, the audible temporal alarm cycle 90 has a duration of four seconds, while the enable period 114 has a duration of eight seconds. Thus, during enable period 114, the remote detectors are able to generate substantially two cycles of the alarm signal. Although two cycles of the alarm signal are selected in the preferred embodiment of the invention, it is contemplated that the enable period 114 could have a different length and enable the generation of a larger or smaller number of alarm cycles while operating within the scope of the present invention.

As illustrated in FIGS. 4, 6 and 7, during each of the alarm interrupt cycles 112, the local detector continues to generate the local alarm signal 99, while each of the remote detectors generates the alarm signal 100 for only the enable periods 114. Since the enable period 114 is selected to be only a small portion of the alarm interrupt cycle 112, the remote detectors generate the alarm signal 100 for only brief periods of time, while the local detector continuously generates the local alarm signal 99.

As can be understood by the prior description, the remote detectors continue to generate an audible alarm for the enable periods 114 during the alarm interrupt cycles 112. Thus, the home occupant cannot fall into a state of complacency after causing the system to enter the Temporary Alarm Locate with Intermittent Warning (TAL w/IW) mode. Instead, the home occupant is continually reminded in a periodic manner of the detected adverse condition by the activation of all of the remote detectors.

As can be understood in FIGS. 6 and 7, the alarm interrupt cycle 112 is repeated for the entire duration of the temporary alarm locate period, although only a portion of the alarm locate period is shown. After the expiration of the alarm locate period, each of the remote detectors will generate the alarm signal continuously if the local detector continues to detect the adverse condition. Thus, the generation of the alarm signal by the remote detectors is intermittently disabled for only the Temporary Alarm Locate with Intermittent Warning (TAL w/IW) period.

In the above description, the beginning of the Temporary Alarm Locate with Intermittent Warning (TAL w/IW) (temporary alarm locate) period is initiated by activating the test switch on any of the remote detectors 18 during the period of time that the remote detectors and the local detector are generating the alarm signal. As indicated in FIG. 5, the actuation of the test switch on any of the remote detectors 18 creates the test pulse 106 that begins the temporary alarm locate period. It is contemplated that the test switch could also be located remotely from the detectors and connected to the alarm system.

In accordance with the present invention, if the test switch is actuated by the occupant on the local detector rather than one of the remote detectors, the actuation of the test switch causes the microprocessor 22 to generate a signal to the hush circuit 58, which begins the hush period. If, for example, the level of the adverse smoke condition is below the adjusted sensitivity level of the smoke detector ASIC 54, the local alarm signal 99 and the interconnect signal 102 will be terminated such that all of the remote detectors will also cease generating the alarm signal. Thus, the entry into the temporary alarm locate period is controlled by the actuation of the test switch on any of the remote detectors, while activation of the test switch on the local detector (the detector sensing the adverse condition) will initiate the hush period.

In the embodiment of the invention illustrated in FIG. 2, the adverse condition detector 18 is controlled by a microprocessor 22. The microprocessor-based adverse condition detector 18 can be used in an interconnected system having other adverse condition detectors utilizing a similar microprocessor 22, or can be used in combination with older, less advanced adverse condition detectors that utilize an ASIC as the sole basis for the alarm function. In an ASIC-based adverse condition detector, the legacy interconnect signal 102 is a simple DC level as indicated in FIG. 3*b*.

As indicated in FIG. 2, the microprocessor-based adverse condition detector 18 includes a legacy interconnect interface 76 that allows the microprocessor 22 to communicate with ASIC-based "legacy" alarms. Further, the microprocessor 22 is able to communicate to other microprocessor-based detectors through the digital interconnect interface 74 using a different form of interconnect signal. Thus, the adverse condition detector 18 is able to control the activation of the various types of alarm signals generated by remote alarm units through the I/O port 72.

Figure 8:
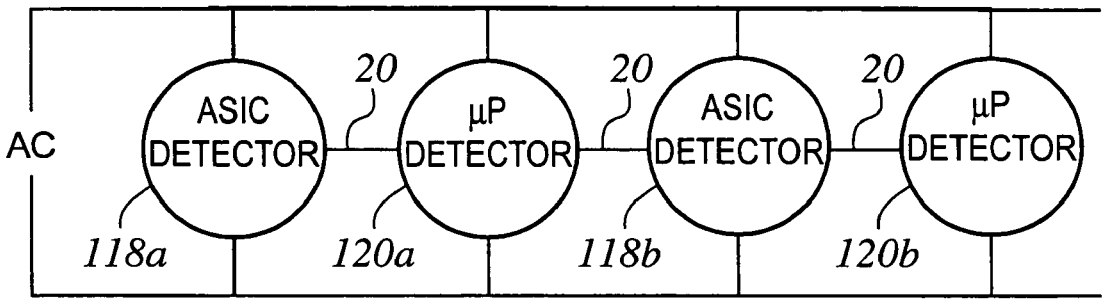
FIG. 8 is a schematic illustration showing the connection of multiple adverse condition detectors that are either microprocessor-based or ASIC-based.

Referring now to FIG. 8, thereshown is a schematic illustration of a system of interconnected adverse condition detectors that operate in accordance with the present invention. The system includes a pair of legacy devices, or ASIC-based adverse condition detectors 118*a* and 118*b* and a pair of microprocessor-based detectors 120*a* and 120*b*. The ASIC detectors 118*a* and 118*b* are coupled to the microprocessor-based detectors 120*a* and 120*b* by the common conductors 20, as was illustrated in FIG. 1. Although the schematic of FIG. 8 illustrates two microprocessor-based detectors and two ASIC detectors, it is contemplated that the system could be comprised of any combination of detector types while operating within the scope of the present invention.

In a first operating example, assume that the microprocessor-based detector 120*a* is the detector actually sensing the adverse condition. The microprocessor-based detector

Figure 3C:
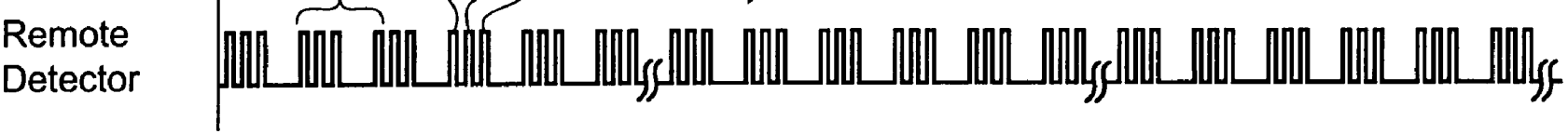
FIG. 3*c* is an illustration of the alarm signal produced by the remote detectors upon receipt of the interconnect signal.

120*a* becomes the local detector and begins to generate the local audible alarm signal 99 as illustrated in FIG. 3*a*. At the same time, the microprocessor-based detector 120*a* generates the interconnect signal 102 of FIG. 3*b* to the pair of ASIC detectors 118*a* and 118*b* through the legacy interconnect interface 76 (FIG. 2) and the I/O port 72. Upon receiving the interconnect signal 102, both of the remote ASIC detectors 118*a* and 118*b* begin to generate the audible alarm signal as shown in FIG. 3*c*.

At the same time, the local detector 120*a* generates a digital interconnect signal to the other microprocessor-based detector 120*b* to control the generation of the audible alarm signal by the detector 120*b*. The digital signal is sent through the digital interconnect interface 74 and also through the I/O port 72. Upon receiving the digital interconnect signal, the remote detector 120*b* also begins to generate the audible alarm signal.

During the generation of the alarm signal by all of the remote devices, if the test switch on the remote microprocessor-based detector 120*b* is actuated, the remote detector 120*b* sends a digital signal to the local detector 120*a* to begin the TAL w/IW period. Upon receiving the signal, the local microprocessor-based detector 120*a* utilizes internal programming to control the level of the interconnect signal 102 to define the alarm interrupt cycle 112, including the enable period 114 and the disable period 116, as illustrated in FIG. 6. At the same time, the detector 120*a* sends the digital intelligent signal to the other microprocessor-based detector 120*b* only during the enable period 114, such that the detector 120*b* generates the alarm signal only during the enable period 114.

In a second operating condition, assume that the ASIC detector 118*a* is the detector sensing the adverse condition. The ASIC detector 118*a* becomes the local detector and generates the audible alarm signal 99 illustrated in FIG. 3*a*. At the same time, the local ASIC detector 118*a* generates the interconnect signal 102 of FIG. 3*b* that causes the remaining detectors 118*b*, 120*a* and 120*b* to also generate the audible alarm signal.

During the generation of the audible alarm signal by the remote detectors, if the test switch 60 is actuated on either of the microprocessor-based detectors 120*a* or 120*b*, the internal programming of the microprocessor begins the TAL w/IW period. During the TAL w/IW period, the microprocessor seizes control of the common conductors and thus the level of the interconnect signal. Specifically, the remote microprocessor-based detector 120*a* or 120*b* causes the potential on the common conductors 20 to be ground (zero volts) during the disable periods 116 and allows the potential on the common conductors to reach the high level 104 during the enable periods 114, as illustrated in FIG. 6. Thus, the remote microprocessor detector 120, upon which the test switch was actuated, controls the Temporary Alarm Locate with Intermittent Warning period for the system of interconnected adverse condition detectors illustrated in FIG. 8.

Figure 9:
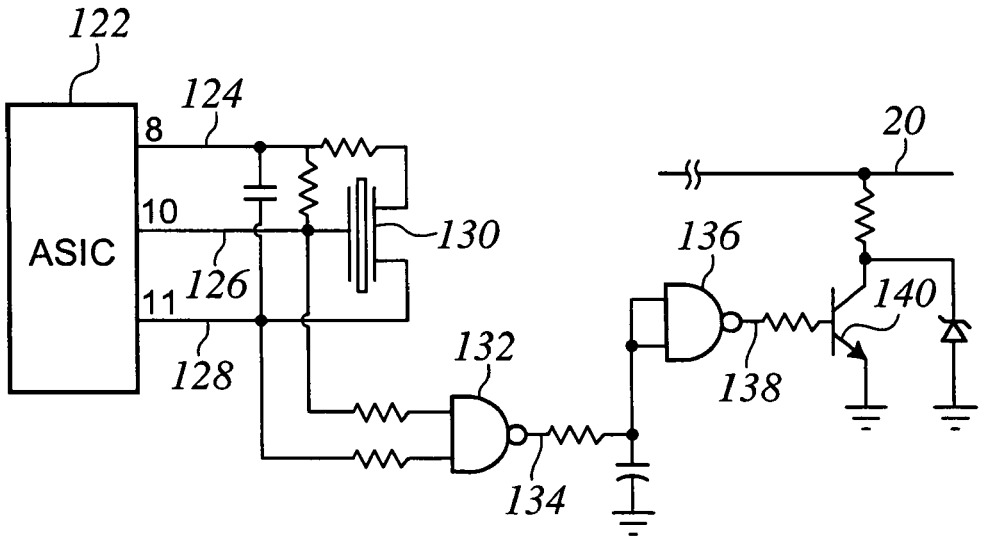
FIG. 9 is a circuit schematic illustrating the circuit utilized by an ASIC-based adverse condition detection apparatus to generate the interconnect signal illustrated in FIG. 6.

In the above description, if the test switch is depressed on the remote ASIC detector 118*b* instead of one of the microprocessor-based remote detectors 120*a* or 120*b*, it is contemplated by the inventor that a unique circuit could be designed to exert control over the interconnect signal on the common conductors 20. Referring now to FIG. 9, thereshown is a contemplated circuit for controlling the interconnect signal. As illustrated in FIG. 9, the ASIC-based adverse condition detector 118 includes a new ASIC 122 having a defined number of connection pins, usually 16. Although integrated circuits can generally be manufactured with multiple pin numbers and configurations, the very specialized adverse condition detector industry has utilized an ASIC package with 16 pins for at least 25 years. As a result, there are many infrastructures at both the ASIC manufacturer and the adverse condition detector manufacturer that would benefit from keeping the ASIC package with the same number of pins, specifically 16. Although adding one or two pins to achieve additional functionality is always physically possible, the advantages of keeping the package size and previous functionality consistent outweigh the benefits of the additional pins for the adverse condition detector ASIC. Consequently, FIG. 9, as described in the next paragraph, presents a method to multiplex the use of existing pins and existing functionality in order to gain additional novel functionality needed for the functionality of Temporary Alarm Locate with Intermittent Warning in a legacy detector.

As illustrated in FIG. 9, pins 124, 126 and 128 are used to operate a traditional horn circuit including a piezoelectric horn 130, as is conventional. The horn 130 is driven by the signals on pins 126 and 128 being out of phase. Thus, a constantly alternating condition of a high signal on pin 126 and a low signal on pin 128, or a low signal on pin 126 and a high signal on pin 128, will cause the horn 130 to operate. During periods of non-operation of the horn 130, the potential on pins 126 and 128 is at ground. Traditionally, the pins 126 and 128 are held at ground during non-operation to help avoid the problem of silver electro-migration across the silver surface of the piezo disk that might otherwise occur during a constant voltage difference being applied to the horn 130.

In accordance with the invention, if the test switch on the legacy ASIC-based detector 118 is depressed when the ASIC 122 is receiving the interconnect signal, the internal programming of the ASIC will be operated to control the level of the interconnect signal as follows. Initially, the internal logic on the remote ASIC-based detector 118 starts the timing of the Temporary Alarm Locate with Intermittent Warning period.

As soon as the first enable period 114 in FIG. 7 terminates, the ASIC 122 generates a high signal on both pins 126 and 128. The high signals on pins 126 and 128 are fed into a NAND gate 132. The NAND gate 132 generates a low signal at its output 134 which is applied to both terminals of a second NAND gate 136. Upon receiving a pair of low inputs, the NAND gate 136 generates a high output through resistor 138 to the base of transistor 140. When the transistor 140 receives the high signal at its base, the transistor 140 is saturated, which grounds the common conductor 20 through the transistor 140. Thus, upon generation of a high signal at both pins 126 and 128, the common conductors 20 are clamped to ground, which results in the low level 108 for the legacy interconnect signal 105 that is being generated by another interconnected adverse condition detector during the disable period 116, as illustrated in FIG. 6.

During the activation time of the Temporary Alarm Locate with Intermittent Warning period, there exist time periods as shown in FIG. 6 where the common conductors 20 are released from their grounded potential, so that all remote legacy alarm devices can sound the appropriate alarm signal as shown in 114. Once the internal logic of the ASIC 122 determines that the disable period 110 (during the first cycle of non-alarm) or 116 (during subsequent cycles of non-alarm) has ended, the output pins 126 and 128 momentarily return to zero volts and deactivate the transistor 140 through the NAND gates 132 and 136, which correspondingly releases the common conductors 20. At this time the ASIC 122 drives piezo horn 130 with an appropriate signal, such that neither pin 126 nor 128 would be at a logic high level simultaneously. Therefore, the NAND gate 132 would still continue to output a high level at 134 while the piezo horn is being activated. After the common conductors have been released, all other interconnected adverse condition detectors operate to generate the audible alarm signal, assuming that the interconnect signal from the original and initiating adverse condition detector is still present. This repeating condition of alternately activating and deactivating both the piezo horn 130 and the common conductors 20 is generally illustrated by 112 in FIG. 6 and FIG. 7., and happens for the entire duration of the Temporary Alarm Locate with Intermittent Warning period as controlled by ASIC 122. In using this method of seizing and grounding the common conductors 20, one legacy smoke alarm with circuitry as illustrated in FIG. 9 can control the interconnect functionality of a network of interconnected legacy smoke alarms.

The above description of FIG. 9 is one embodiment of an operating circuit that allows a "legacy device" driven by an ASIC to create the temporary alarm locate period by utilizing external circuitry. It should be understood that the specific configuration of the circuitry in FIG. 9 is only one embodiment of the invention and other alternate circuits operating within the scope of the invention could be utilized. However, the circuitry illustrated in FIG. 9 allows the ASIC 122 to provide a Temporary Alarm Locate with Intermittent Warning control signal by utilizing two pins 126 and 128 that are currently used only to operate the horn 130. Thus, the otherwise fully utilized ASIC 122 can be used to generate a control signal in addition to the piezo horn, that new signal being the Temporary Alarm Locate with Intermittent Alarm.

Various alternatives and embodiments are contemplated as being within the scope of the following claims particularly pointing out and distinctly claiming the subject matter regarded as the invention.

I claim:

1. In a system of interconnected adverse condition detectors each operable to sense an adverse condition and generate both a local alarm signal and an interconnect signal that is transmitted to the other adverse condition detectors, wherein each adverse condition detector generates an alarm signal upon generation of the local alarm signal by the detector or receipt of the interconnect signal from another of the interconnected adverse condition detectors, a method of determining which adverse condition detector is sensing an adverse condition, comprising:

providing a test switch on each of the adverse condition detectors;

initiating an alarm locate period upon activation of the test switch on any one of the adverse condition detectors when all of the adverse condition detectors are simultaneously generating the alarm signal;

disabling the generation of the alarm signal by all of the adverse condition detectors except for the adverse condition detector generating the local alarm signal for the alarm locate period, wherein the adverse condition detector sensing the adverse condition generates the alarm signal for the entire alarm locate period; and intermittently enabling the generation of the alarm signal by all of the adverse condition detectors during the alarm locate period.

2. The method of claim 1 wherein the generation of the alarm signal by all of the adverse condition detectors except the adverse condition detector generating the local alarm signal is enabled for multiple enable periods during the alarm locate period.

3. The method of claim 2 wherein the alarm signal includes a plurality of repeating alarm cycles each having an alarm duration, wherein the enable period is at least as long as the alarm duration.

4. The method of claim 3 wherein the enable period is a multiple of the alarm duration.

5. The method of claim 1 further comprising the step of enabling the generation of the alarm signal by all of the adverse condition detectors after expiration of the alarm locate period.

6. The method of claim 1 wherein the initiation of the alarm locate period occurs upon activation of the test switch on any of the adverse condition detectors except the adverse condition detector generating the local alarm signal.

7. The method of claim 6 further comprising the step of disabling the generation of the alarm signal by all of the adverse condition detectors for a hush period upon actuation of the test switch on the adverse condition detector generating the local alarm signal.

8. The method of claim 1 wherein each of the adverse condition detectors is a smoke detector.

9. The method of claim 8 wherein the alarm signal is an audible signal.

10. In a system comprising at least one interconnected ASIC-based adverse condition detector and at least one interconnected microprocessor-based adverse condition detector each operable to sense an adverse condition and generate both a local alarm signal and an interconnect signal that is transmitted to the other adverse condition detectors over a common conductor, wherein each adverse condition detector generates an alarm signal upon generation of the local alarm signal or receipt of the interconnect signal from another of the interconnected adverse condition detectors over the common conductor, a method of controlling the interconnect signal comprising the steps of:

connecting an interconnect control circuit between each of the ASIC-based adverse condition detectors and the common conductor;

initiating an alarm locate period in the ASIC-based adverse condition detector upon activation of a test switch on the ASIC-based adverse condition detector when the interconnect signal is being transmitted over the common conductor;

generating a disable signal from the ASIC-based adverse condition detector during the alarm locate period, the disable signal being provided to the interconnect control circuit such that the interconnect control circuit neutralizes the interconnect signal on the common conductor to disable the generation of the alarm signals by all of the adverse condition detectors except for the adverse condition detector generating the local alarm signal; and intermittently disrupting the disable signal to the interconnect control circuit during the alarm locate period such that the interconnect control circuit allows the interconnect signal on the common conductor to cause the generation of the alarm signal by all of the interconnected adverse condition detectors.

11. The method of claim 10 wherein the interconnect control circuit is connected to both a first pin and a second pin of an ASIC included in the ASIC-based adverse condition detector.

12. The method of claim 11 wherein the first pin and the second pin of the ASIC are connected to a horn such that the ASIC-based adverse condition detector generates the alarm signal by activation of the horn.

13. The method of claim 10 wherein the interconnect control circuit grounds the common conductor to neutralize the interconnect signal.

14. The method of claim 12 wherein the horn is operable by a high signal on the first pin and a low signal on the second pin, wherein the interconnect control circuit neutralizes the interconnect signal when a high signal is on both the first pin and the second pin.

15. The method of claim 11 wherein the ASIC is a sixteen pin ASIC and the first pin and the second pin are driving pins for a piezoelectric horn.

16. The method of claim 10 wherein the interconnect control circuit includes a transistor connected between the common conductor and ground, wherein the interconnect signal is neutralized by activating the transistor to ground the common conductor.

17. A method of determining which adverse condition detector of a plurality of interconnected adverse condition detectors is sensing an adverse condition during the generation of an alarm signal by all of the adverse condition detectors, wherein each of the adverse condition detectors generates an alarm signal upon any one of the adverse condition detectors sensing the adverse condition, the method comprising:

selectively initiating an alarm locate period during the generation of the alarm signal by all of the adverse condition detectors, the alarm locate period having a predetermined duration, wherein the alarm locate period is initiated by actuating a switch contained on any one of the interconnected adverse condition detectors, wherein each of the adverse condition detectors includes the switch; and intermittently disabling the generation of the alarm signal by all of the plurality of adverse condition detectors except the adverse condition detector sensing the adverse condition during the alarm locate period, wherein the adverse condition detector sensing the adverse condition generates the alarm signal for the entire alarm locate period.

18. The method of claim 17 wherein the switch is a multi-function test switch contained on each of the adverse condition detectors.

19. The method of claim 17 wherein the alarm locate period includes a plurality of disable periods and a plurality of enable periods, wherein the generation of the alarm signal by all of the adverse condition detectors except the adverse condition detector sensing the adverse condition is disabled during the disable periods and enabled only during the enable periods.

20. The method of claim 19 wherein the duration of the disable periods is substantially greater than the duration of the enable periods.

21. The method of claim 20 wherein the duration of the disable period is at least twice as long as the duration of the enable period.

22. The method of claim 19 wherein the alarm signal includes a plurality of repeating alarm cycles each having an alarm duration, wherein the enable period is a longer alarm duration of the alarm cycle such that the alarm signal is generated for at least one alarm cycle during each enable period.

23. The method of claim 22 wherein the enable period is twice as long as the alarm duration of the alarm cycle.

* * * * *